US008235677B2

(12) United States Patent
Cai et al.

(10) Patent No.: US 8,235,677 B2
(45) Date of Patent: Aug. 7, 2012

(54) COMPRESSING DIAPHRAGM PUMP HAVING AUTOMATIC AIR EXPELLING AND PRESSURE ABNORMAL-PREVENTING FEATURES FOR SPRAY USE

(76) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 815 days.

(21) Appl. No.: 12/230,724

(22) Filed: Sep. 4, 2008

(65) Prior Publication Data

US 2009/0068036 A1 Mar. 12, 2009

Related U.S. Application Data

(60) Provisional application No. 60/935,964, filed on Sep. 7, 2007.

(51) Int. Cl.
*F04B 35/04* (2006.01)

(52) U.S. Cl. ..... 417/86; 417/65; 417/68; 417/69; 417/87; 417/88; 417/89

(58) Field of Classification Search ..... 417/1–47, 417/321–410.5
See application file for complete search history.

(56) References Cited

U.S. PATENT DOCUMENTS

| | | | | |
|---|---|---|---|---|
| 6,439,481 | B2 * | 8/2002 | von Schuckmann | 239/333 |
| 7,004,404 | B2 * | 2/2006 | Robinson | 239/296 |
| 2006/0090642 | A1 * | 5/2006 | Hsu et al. | 92/172 |
| 2007/0201985 | A1 * | 8/2007 | Hsu | 417/32 |

* cited by examiner

*Primary Examiner* — Tracie Y Green
(74) *Attorney, Agent, or Firm* — Bacon & Thomas, PLLC

(57) ABSTRACT

A compressing diaphragm pump having automatic air expelling and pressure abnormal-preventing features for spray use has a hollow tubular air discharge assembly having a plunger body and compressed spring as well as an air passage pierced at the wall of the water exit port and an air discharge orifice pierced of the central top surface of the air discharge assembly for connecting with the plunger body. When air is mixed within the pressurized water, the resilient force of the compressed spring is bigger than the water pressure of the pressurized water. This allows the air mixed in the pressurized water to get into the air passage and pass the plunger opening of the plunger body via through pore, and is dispelled out of the upper hood via the air discharge orifice of the air discharge assembly.

2 Claims, 16 Drawing Sheets

COMPRESSING DIAPHRAGM PUMP HAVING AUTOMATIC AIR EXPELLING AND PRESSURE ABNORMAL-PREVENTING FEATURES FOR SPRAY USE

This application claims the benefit of provisional U.S. Patent Application No. 60/935,964, filed Sep. 7, 2007.

FIELD OF THE PRESENT INVENTION

The present invention relates to a compressing diaphragm pump equipped on the compressing water cleaning apparatus for spray use that constantly supply stable water pressure without abnormal pressure happening during operation, particularly benefits to enhance the spray cleaning effect.

BACKGROUND OF THE INVENTION

As shown in the FIG. 1 of the current marketing conventional pressurized cleaning apparatus for spraying and washing the vehicle comprises a water sprayer 1, a portable tank 2 and a compressing diaphragm pump 10. Its features are that the small compressing diaphragm pump 10 can be put into the portable tank 2 and power supply can be taken from the existing 24 volt DC of the cigar-lighter in the vehicle as well as convenient availability of water source everywhere for feeding the portable tank 2 so as to move outdoor for doing the job of spraying and washing the vehicle. For operation of such conventional compressing diaphragm pump 10, via water entry 61 on the upper hood 60 of the compressing diaphragm pump 10 by way of water intake conduit 3, the tap water W is first sucked into the portable tank 2, where the tap water is converted into pressurized water, then sent to the water sprayer 1 via water outtake conduit 4 for spray application. Therefore, the function of the compressing diaphragm pump 10 will primarily affect the operation and the pressure stability of the output water of such cleaning apparatus.

However, two drawbacks exist in the operation procedure of such conventional cleaning apparatus: A. residual air bubbles: the water is poured into the portable tank 2 for refilling when water is run out, the remaining air in the some parts, especially the water intake conduit 3, of such compressing diaphragm pump 10. During next operation, the remaining air will mix with water as air bubbles and get into the operating parts, especially the upper hood 60, of such compressing diaphragm pump 10 to adversely affect the total function, namely jerking vibration of the parts and intermittent instability of the water pressure, which results in harmful load to integral apparatus with shortening service lifetime for long term operation. Thus, how to expel the residual air bubbles mixing in the water during refilling the water becomes the critical problem of such apparatus.

B. abnormal pressure: the phenomena of abnormal pressure will happen in association with increase of the operating time and frequency of such compressing diaphragm pump 10. To understand the cause of the abnormal pressure, the structural and operation functions of each component in the compressing diaphragm pump 10 should be penetrated as below:

As shown in the FIGS. 2 to 6, the conventional compressing diaphragm pump 10 comprises a motor 11, a upper hood chassis 12 disposed along the top of the output shaft not shown in the figures of said motor 11 with plural screw bores 13 being formed on its outer rim, a diaphragm 20 covering said upper hood chassis 12, a piston valve 30 inset in said diaphragm 20, a plastic anti-backflow plastic gasket 40 with three piston slices 50 closely fixed on said piston valve 30 respectively and a upper hood 60 with plural perforated bore

63 being formed on its outer rim, wherein multiple wobble wheels 14 are pivoted on said upper hood chassis 12 to serve as the pumping action in manner from axial reciprocal wobbling movement being driven by the output shaft of said motor 11. By running bolts 5 through all of the corresponding screw bores 13 on said upper hood chassis 12 and perforated bore 63 on said upper hood 60, the whole compressing diaphragm pump 10 is completely integrated (as shown in the FIG. 4).

For said diaphragm 20, a gasket groove 21 is configured on its top peripheral rim and three convex humps 22, each of which being stacked by an eccentric piston pushers 23 respectively, are disposed thereon in corresponding with said three wobble wheels 14. By means of each screw 24 running through each corresponding perforated bore 221 on the convex humps 22 and each perforated bore 231 on the piston pushers 23, each piston pushers 23 and convex humps 22 together with diaphragm 20 is securely screwed on each corresponding wobble wheels 14 (as shown in the FIG. 4) so that all these said components act in simultaneous axial reciprocal wobbling movement with certain displacement (as indicated by dash-line in the FIG. 4).

As further shown in the FIGS. 2 and 4 through 6, said piston valve 30 mainly comprises a hemispherical water discharge base 31, which being upwardly embedded in its central region towards the upper hood 60, and three water inlet ports 35, each of which being respectively disposed beneath of said water discharge base 31 with equal space of 120° inclined angle each other. Wherein, said water discharge base 31 is configured by a orientating hole 32, which being formed in the center thereof, and three separating grooves 33, which being radial split with equal space of 120° inclined angle each other so that three isolated zones being formed in between with plural water discharge spouts 34 shaped therein; said water inlet port 35 is configured by a orientating hole 36 and plural water inlet slots 37 thereon. Said anti-backflow plastic gasket 40, which being unitarily molded by soft elastic material into hollow hemi-spheroid, comprises a central downwards orientating stem 41 and three radial separating rib panels 42, each of which being equally spaced by 120° inclined angle each other, as well as three projecting panels 43 extended out thereof. By simultaneously infixing said orientating stem 41 into the corresponding orientating hole 32 and inserting each projecting panel 43 into each corresponding separating groove 33 on the water discharge base 31, all the water discharge slots 34 in each of three isolated zones of the water discharge base 31 are completely blocked by the anti-backflow plastic gasket 40 in close seal manner around the circumferential rim (as shown in the FIG. 4). Each of said piston slice 50, which has a rigid central orientating stem 51 formed upwardly, is unitarily molded by soft elastic material into inverted flare shape with convex arched outer surface and concave curved inner surface. By inserting said orientating stem 51 into each corresponding orientating hole 36 on the water inlet port 35, all the water inlet slots 37 are completely blocked by the piston slice 50 in close seal manner around the circumferential rim (as shown in the FIGS. 4 and 5); Wherein, plural low pressure chambers 6 are respectively formed between the concave curved inner surface of said piston slice 50 on each water inlet port 35 of the piston valve 30 and the corresponding piston pusher 23 of the diaphragm 20 with one end whereof connecting to the corresponding water inlet slots 37 (as shown in the FIG. 4).

As further shown in the FIGS. 1 and 2 through 4, said upper hood 60 with plural perforated bore 63 formed on the peripheral rim thereof, mainly comprises an water inlet orifice 61 on the external rim, a water exit port 64 in the central top with an internal water outlet orifice 62 therein and an external pressure switch vessel 65 connected thereon for mounting a pressure switch P sold in the current market. Wherein, a ramp groove 66 is configured at the bottom side thereon so that its peripheral rim closely encompasses the piston valve 30 and securely anchors on the gasket groove 21 of said diaphragm 20 in matching manner; an central annular groove 67 is downwardly configured inside of the ramp groove 66 for closely affixing with the water discharge base 31 of said piston valve 30 in matching manner so as to create a pressurized chamber 7 in between (as shown in the FIG. 4).

For practical operation, please refer to FIGS. 1, 7 and 8, due to axial reciprocal wobbling movement of the piston pushers 23 driven by the wobble wheels 14, the water W getting into the water inlet orifice 61 of the upper hood 60 from the portable tank 2 via the water intake conduit 3 (as illustrated by arrow head in the FIG. 7) will bear alternate sucking and pushing force of pumping action, namely: If the piston pushers 23 wobbling downwardly away the piston slice 50, the piston slice 50 is simultaneously pulled downwardly away the water inlet port 35 by the sucking force and draws the water W getting into the low pressure chamber 6 orderly via water inlet orifice 61 and water inlet slots 37 (as illustrated by each arrow head in the FIG. 7), in which the water W is firstly pressurized into water W of middle pressure; If the piston pushers 23 wobbling upwardly towards the piston slice 50, the piston slice 50 is simultaneously pushed upwardly towards the water inlet port 35 by the pushing force and thrusts the water W in the low pressure chamber 6 getting into the pressurized chamber 7 via water discharge spouts 34 (as illustrated by each arrow head in the FIG. 8), in which the water W is secondly pressurized into water W of high pressure; By reiterating such alternate sucking and pushing force of pumping action, the pressure of the water W in the pressurized chamber 7 will be escalated up to 80 psi~100 psi for practical spraying and washing use or other compatible task requirements in the water sprayer 1 orderly via the water outlet orifice 62 and water exit port 64 in the upper hood 60 as well as water outtake conduit 4 connected thereto.

However, there is a serious drawback in the anti-backflow plastic gasket 40 designs that causes unfavorable effect in the operation of the compressing diaphragm pump 10. As depicted on the foregoing description and shown in the FIG. 5, the anti-backflow plastic gasket 40 is unitarily molded by soft elastic material into hollow hemi-spheroid to be used to cover up on all the water discharge spouts 34 of the piston valve 30, whose associated water inlet port 35 in conjunction with piston slice 50 being driven by the axial reciprocal wobbling movement of the piston pushers 23 for alternate sucking and pushing force of pumping action with finite displacement. Due to the flexibility of the material and the uneven hemispherical shape, not only the effect of water discharging is reduced by the limited displacement in pumping action but also the sealing effect in sucking action becomes unsatisfactory. Thereby, both of the quantity and the pressure in the output water are decreased. Such undesirable defective sealing effect in the anti-backflow plastic gasket 40 becomes worse in aging effect of material owing to the deformationδ getting bigger and results in "abnormal pressure" issue (as shown in the FIG. 6).

In order to solve the abnormal pressure issue mentioned above from the deformation of the anti-backflow plastic gasket 40, the inventor of the present invention improved the design thereof and registered the patent application to the USPTO at Oct. 26, 2005 with application number of Ser. No. 11/258,027 (published number of US2006/0090642) as archived. As shown in the FIGS. 9 through 12, the structure of the improved compressing diaphragm pump 10 is to transform both of the anti-backflow plastic gasket 40 and associated water discharge port 71 into planar form instead of original hemispherical shape. Coordinating with such planar conversion of the water discharge port 71 in the piston valve 70, a orientating lump 72 with a orientating hole 73 is formed in the center of the water discharge port 71; Three isolated zones with plural water discharge holes 74 of each zone are formed in equal space of 120° inclined angle each other with said orientating lump 72 as center. On the peripheral rim against the corresponding three isolated zones, three water inlet ports 75 are respectively disposed beneath of said water discharge port 71 with a central orientating hole 76 and plural water inlet slots 77 thereon. Besides, the anti-backflow plastic gasket 80 is configured as planar tri-valvular blade shape to completely cover up on the water discharge port 71 with three radial elongate rifts 81 being equally spaced by 120° inclined angle each other so that each valvular blade exactly attaches and blocks each corresponding water discharge hole 74 on the water discharge port 71; In the center of the anti-backflow plastic gasket 80, a orientating aperture 82 is created with a orientating rim 83 beneath thereof (as shown in the FIG. 10).

For practical assembly, as further shown in the FIGS. 10 and 11, by means of aligning the clutch rim 83 of the anti-backflow plastic gasket 80, the orientating aperture 82 is firstly inset into the orientating lump 72 of the piston valve 70, then the anti-backflow plastic gasket 80 and the piston valve 70 are firmly united by inserting the T-shaped orientating stem 90 into the orientating hole 73 of the piston valve 70.

Please refer to the FIG. 12, not only the "abnormal pressure" issue is significantly improved but also the deformation associated is moderated after a long term trial use of the modified piston valve 70 and anti-backflow plastic gasket 80. However, for a period of trial use, new issues are found as below: A. the integration between piston valve 70 and anti-backflow plastic gasket 80 jointed by the T-shaped orientating stem 90 becomes loosening. B. the strength of the valvular blades turns into rather weakening. C. the slight deformation of the piston slice 50 due to aging still exists. Therefore, the inventor of the present invention constantly studies and researches zealously for the purpose of improving the function and solving the remaining issues of the compressing diaphragm pump 10 mentioned above.

SUMMARY OF THE INVENTION

The primary object of the present invention is to provide a "compressing diaphragm pump having automatic air expelling and pressure abnormal-preventing features for spray use", wherein a hollow tubular air discharge assembly, which connecting at the wall of the water exit port on the top upper hood, having a plunger body and compressed spring disposed therein as well as a air passage pierced at the wall of the water exit port and a air discharge orifice pierced of the central top surface of the air discharge assembly for connecting with the (plunger body); When air being mixed within the pressurized water, the resilient force of the compressed spring will push the plunger baffle of the plunger body forwards into the first air discharge cylinder such that the through pore passing into the first air discharge cylinder owing to the resilient force of the compressed spring being bigger than the water pressure of the pressurized water. Thereby, the air mixed in the pressurized water will get into the air passage and pass the plunger opening of the plunger body via through pore, and finally dispelled out of the upper hood via the air discharge orifice of the air discharge assembly. Thus, not only the mixing air in the water can be automatically expelled for constantly regulating water pressure in stable manner but also the internal components can be simplified with smooth operation and prolong the service lifetime.

The other object of the present invention is to provide a "compressing diaphragm pump having automatic air expelling and pressure abnormal-preventing features for spray use", wherein the top surface of the water discharge port is designed into downwards camber concave with center of the orienting hole as lowest point and each bottom surface of three water inlet ports is designed into upwards camber concave with center of the orienting hole as lowest point. After assembly, a gap is created between the flat bottom surface of the anti-backflow plastic gasket and the downwards camber concave of the water discharge port; similarly, a gap is created between the flat top surface of the piston slice and the upwards camber concave of the water inlet slots. By means of the gaps mentioned above, not only the sucking force in each of the anti-backflow plastic gasket and piston slice in pumping action associated with the axial wobbling movement of the piston pushers is considerably increased but also the compressing effect for the water is significantly promoted; Moreover, owing to the special design for central thickness thicker than that of the rim thickness for both of the anti-backflow plastic gasket and piston slice, not only its strength is better than that of the flat design in the precedent anti-backflow plastic gasket in same thickness comparison, but also the sealing effect on the water discharge holes and water inlet slots during the switch between opening and closing actions is improved; Thereby, the "abnormal pressure" issue has been totally eliminated.

DETAILED DESCRIPTION OF THE PREFERRED EMBODIMENTS

Figure 1:
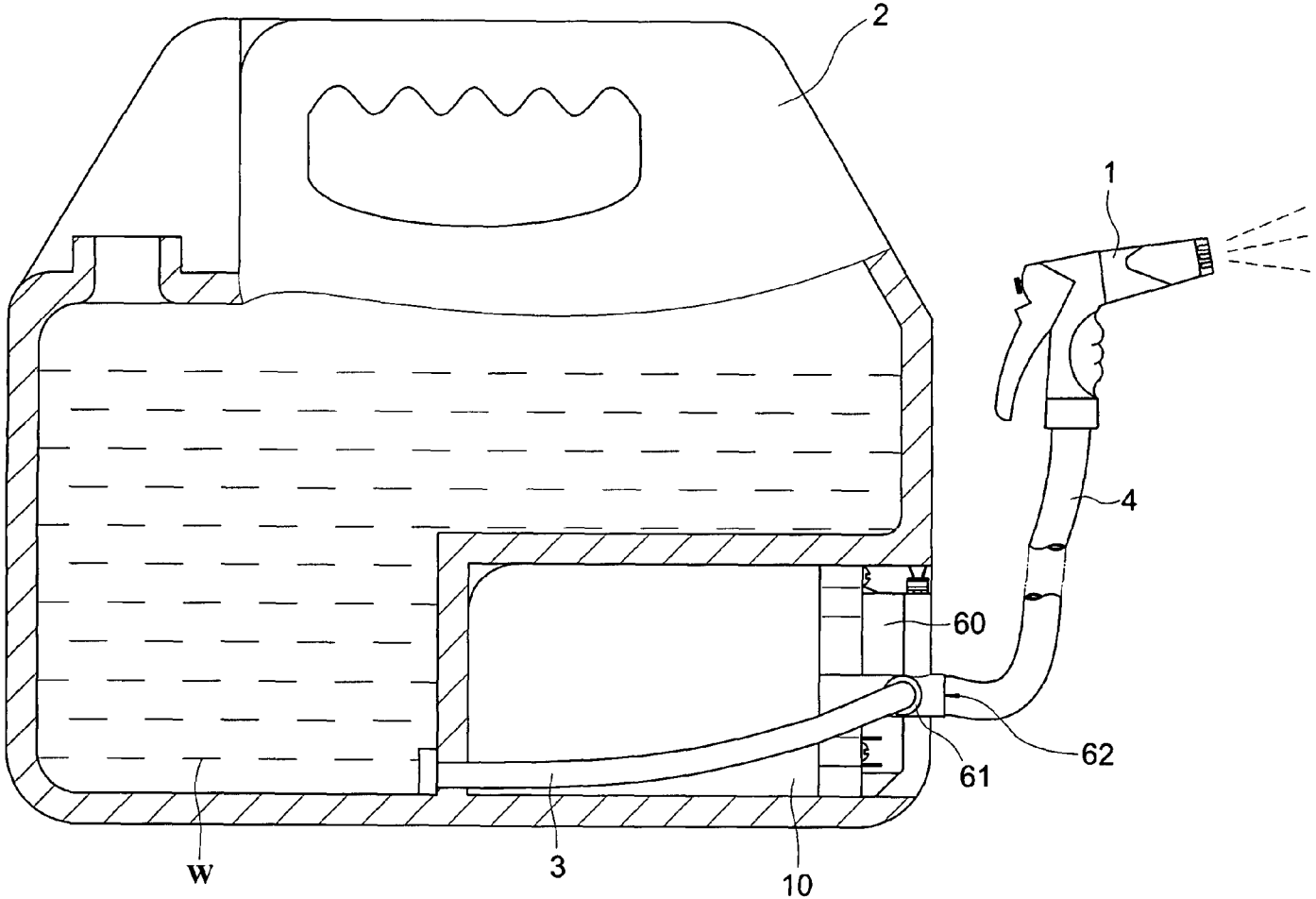
FIG. 1 (PRIOR ART)
FIG. 1 is the illustrative view of the conventional pressurized cleaning apparatus.
Figure 2:
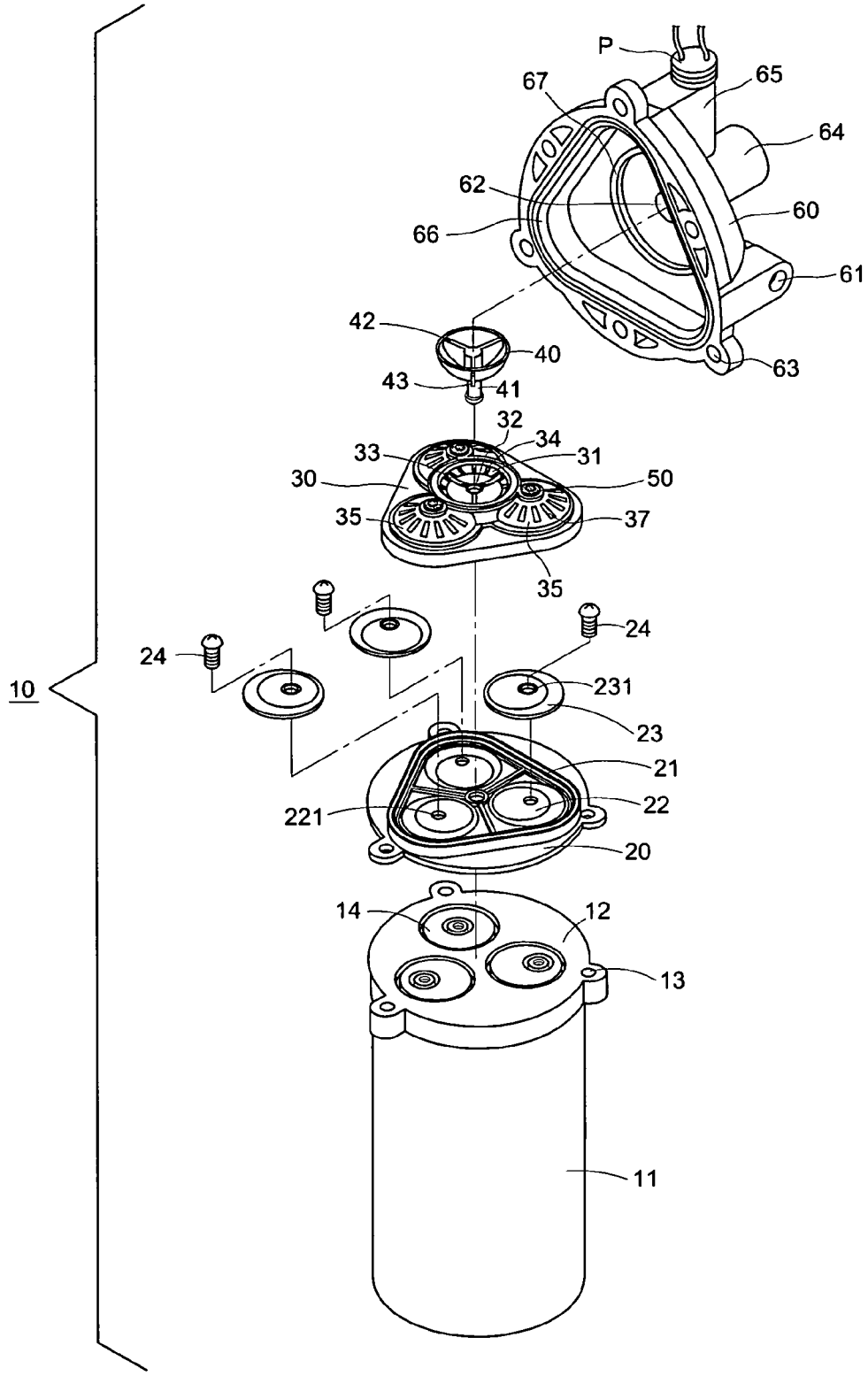
FIG.2 (PRIOR ART)
FIG. 2 is the perspective exploded view of the conventional compressing diaphragm pump for spray use.
Figure 3:
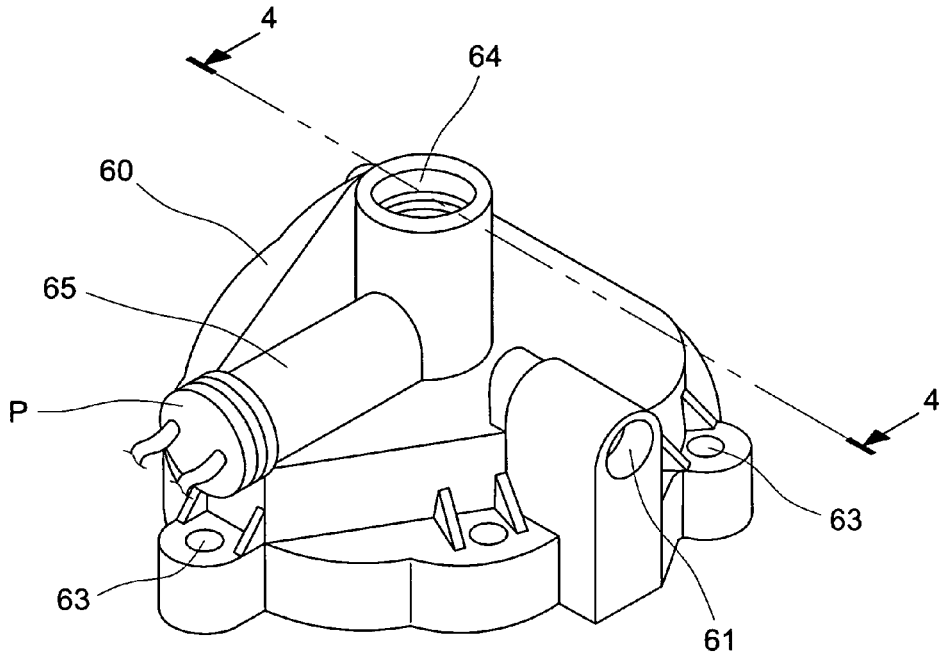
FIG.3 (PRIOR ART)
FIG. 3 is the perspective view showing the upper hood of the conventional compressing diaphragm pump for spray use.
Figure 4:
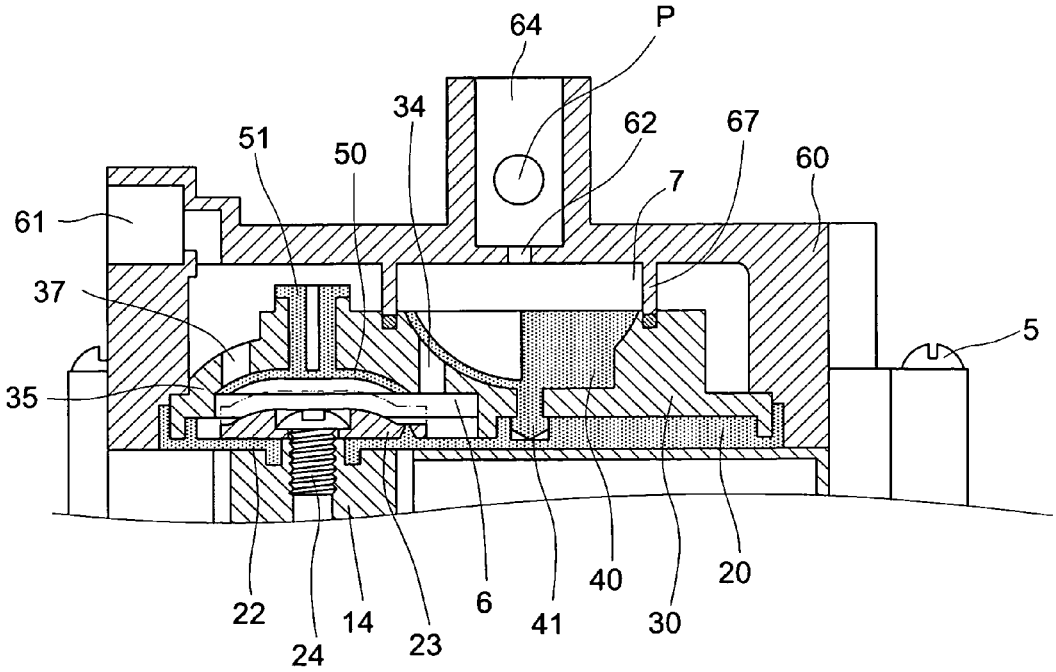
FIG.4 (PRIOR ART)
FIG. 4 is a sectional view taken along the 4-4 line of the FIG. 3.
Figure 5:
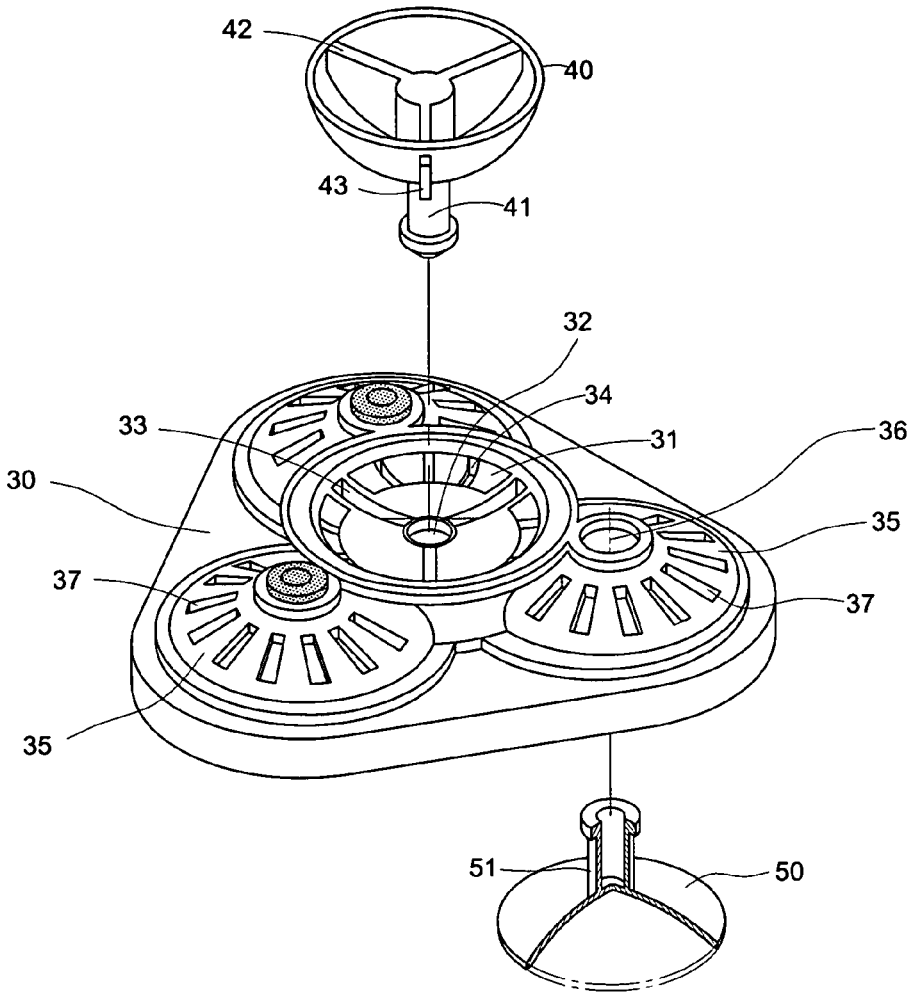
FIG.5 (PRIOR ART)
FIG. 5 is a perspective illustrative view showing the piston valve of the conventional compressing diaphragm pump for spray use.
Figure 6:
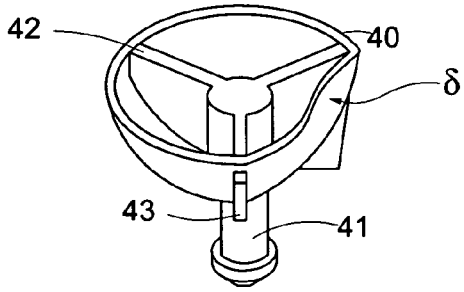
FIG.6 (PRIOR ART)
FIG. 6 is a perspective illustrative view showing the deformation of the anti-backflow plastic gasket in the conventional compressing diaphragm pump for spray use.
Figure 7:
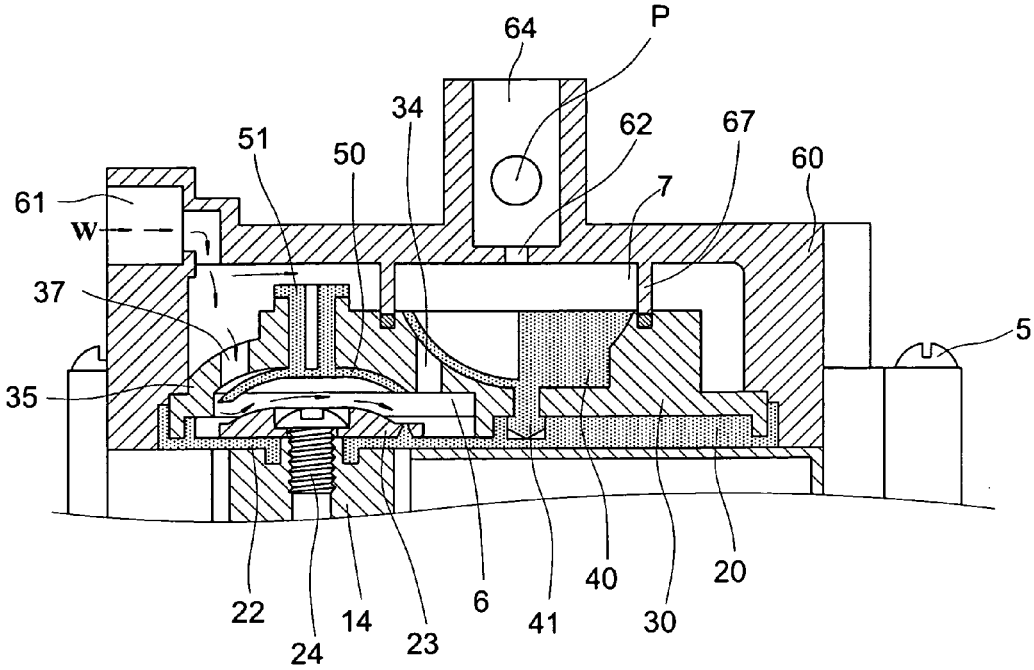
FIG.7 (PRIOR ART)
FIG. 7 is the first illustrative view showing the operation of the conventional compressing diaphragm pump for spray use.
Figure 8:
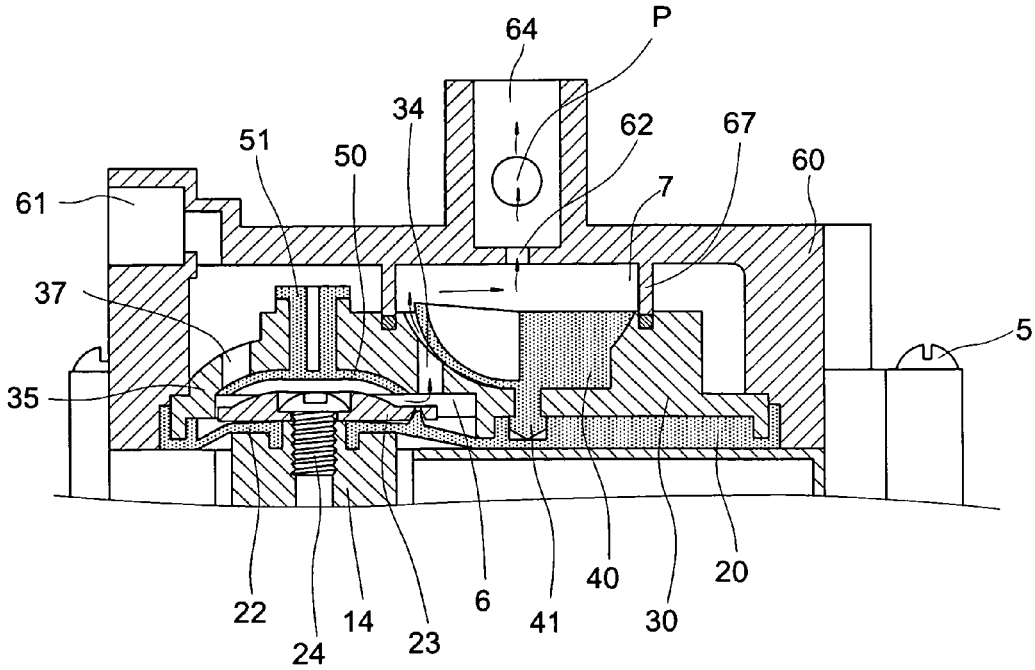
FIG.8 (PRIOR ART)
FIG. 8 is the second illustrative view showing the operation of the conventional compressing diaphragm pump for spray use.
Figure 9:
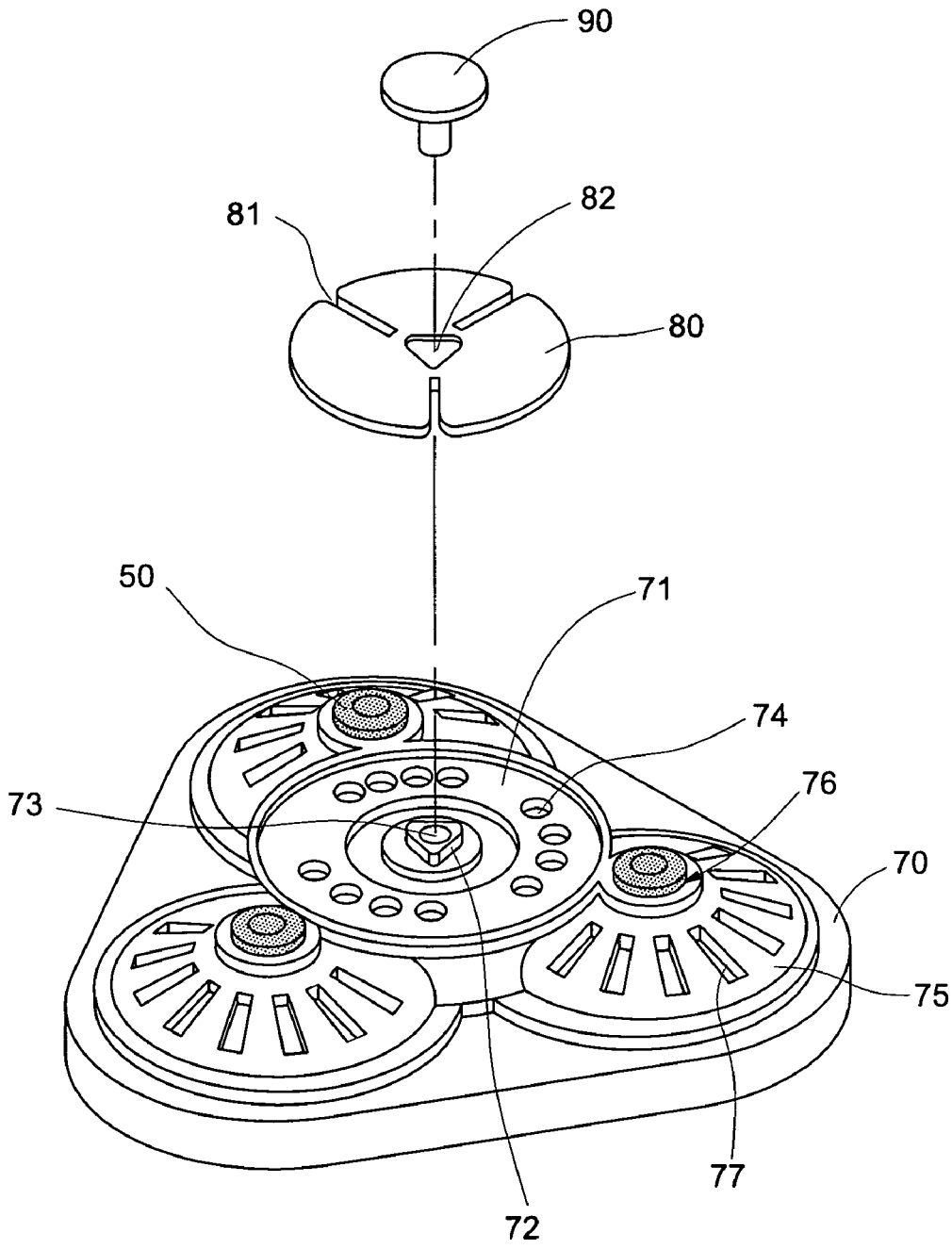
FIG.9 (PRIOR ART)
FIG. 9 is a perspective view showing another piston valve and anti-backflow plastic gasket in the conventional compressing diaphragm pump for spray use.
Figure 10:
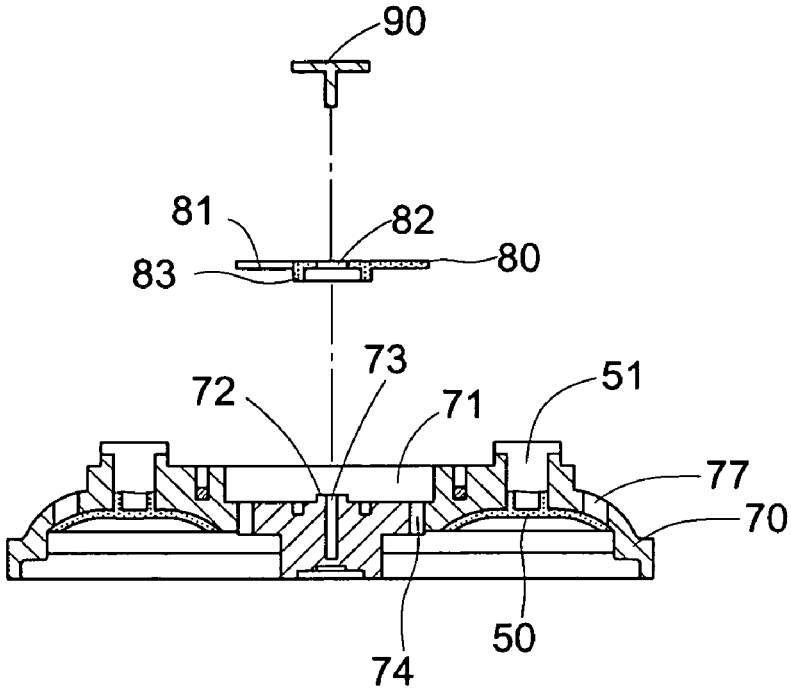
FIG.10 (PRIOR ART)
FIG. 10 is the section illustrative view showing the planar decomposition in the FIG. 9.
Figure 11:
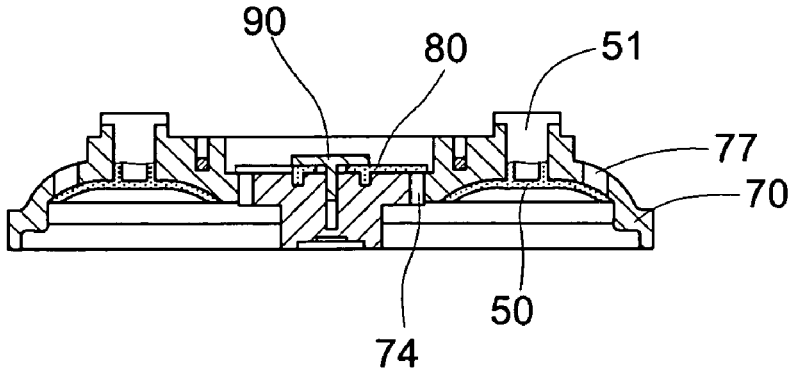
FIG.11 (PRIOR ART)
FIG. 11 is a sectional view showing the planar assembly of the FIG. 10.
Figure 12:
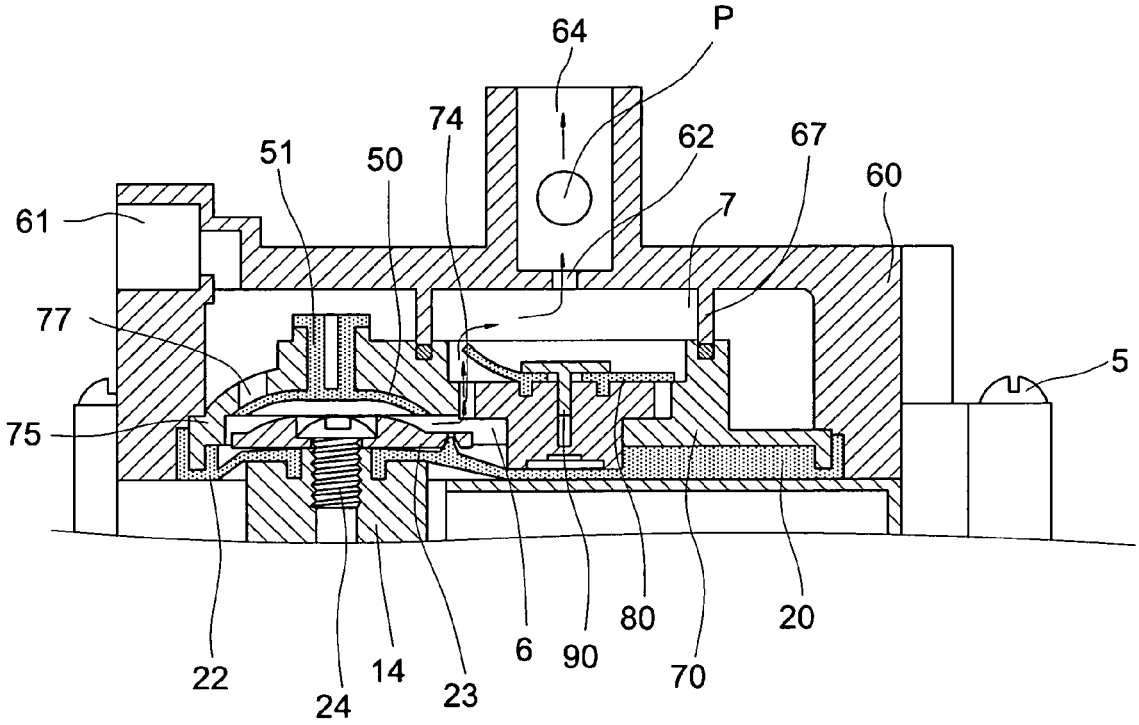
FIG.12 (PRIOR ART)
FIG. 12 is the section illustrative view showing the planar assembly of the conventional compressing diaphragm pump for spray use.
Figure 13:
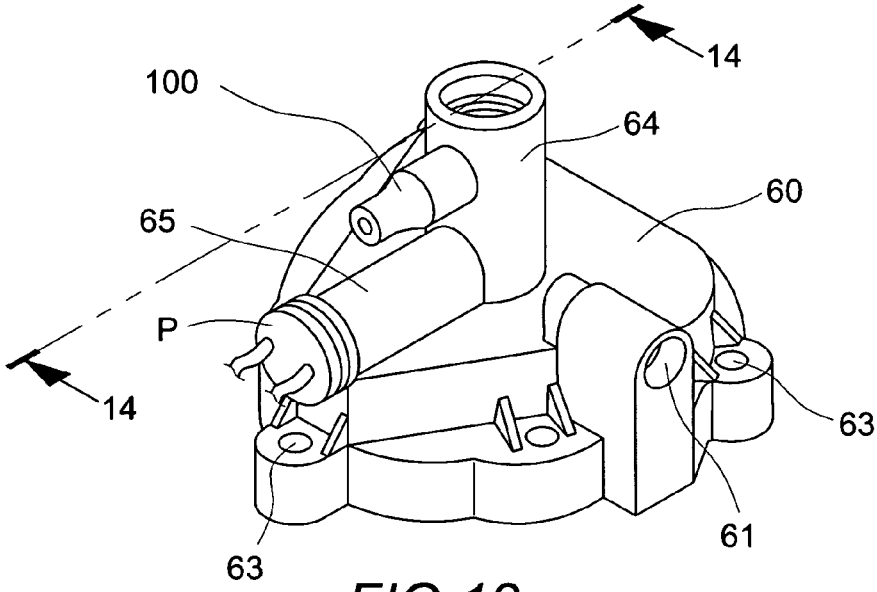
FIG. 13 is a perspective illustrative view of the first exemplary embodiment of the present invention.
Figure 14:
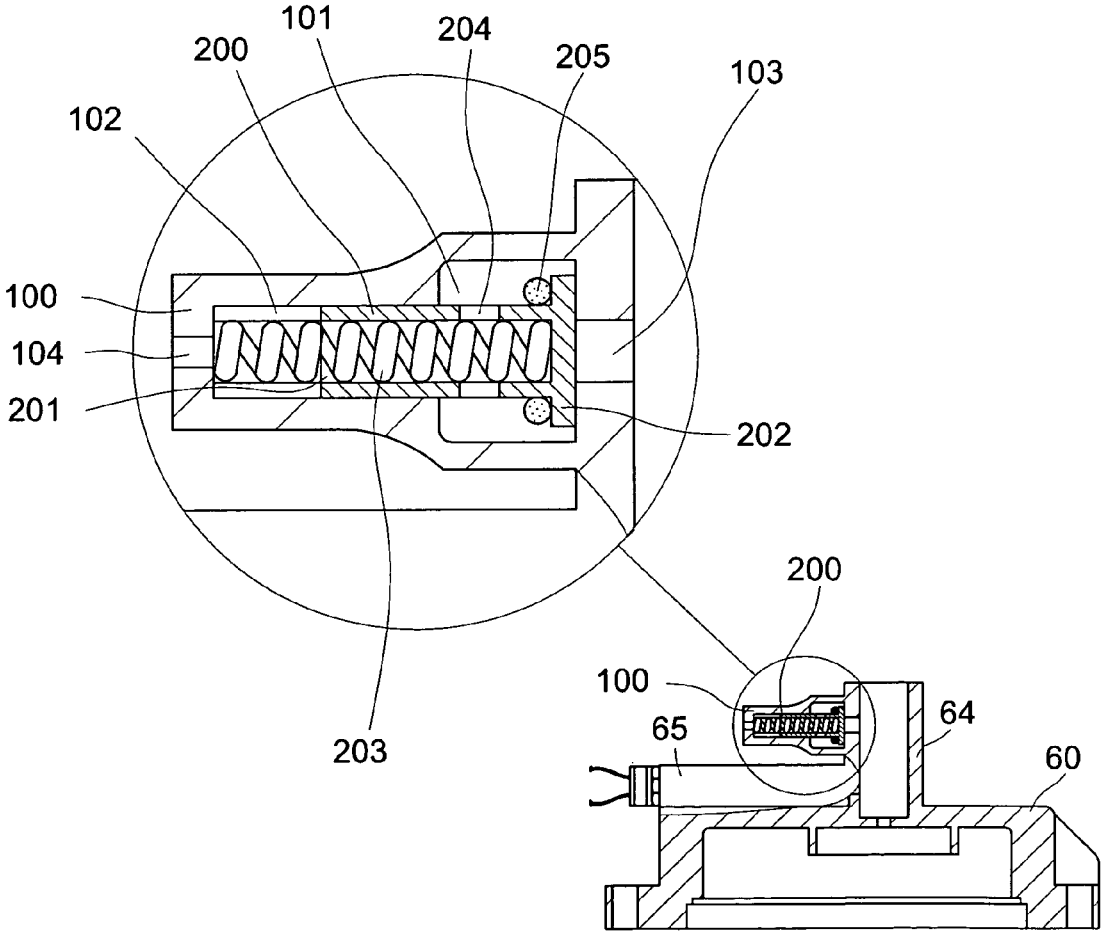
FIG. 14 is the section illustrative view taken along the 14-14 line of the FIG. 13.

As shown in the FIGS. 13 and 14, the first embodiment of the "compressing diaphragm pump having automatic air expelling and pressure abnormal-preventing features for spray use" for the present invention comprises:

an air discharge assembly 100, which is a hollow tube connecting at the wall of the water exit port 64 on the top upper hood 60 of the compressing diaphragm pump 10 for spray use, having a pair of first air discharge cylinder 101 and second air discharge cylinder 102 running freely through each other disposed on the upper section and lower section thereof respectively such that the diameter of the first air discharge cylinder 101 being larger than that of the second air discharge cylinder 102, wherein, an air passage 103 is pierced at the wall between the first air discharge cylinder 101 and the water exit port 64 of the top upper hood 60 as well as an air discharge orifice 104 is pierced of the central top surface of the air discharge assembly 100 facing towards the second air discharge cylinder 102, and a plunger body 200, which is a hollow tube with a top plunger opening 201 and a bottom plunger baffle 202 with outer diameter of the plunger opening 201 is smaller than that of the plunger baffle 202, having a compressed spring 203 disposed therein from the plunger opening 201 facing inwards and a through pore 204 pierced on the wall thereof near the plunger baffle 202 as well as an O-ring gasket 205 rimmed thereon the peripheral between the through pore 204 and the plunger baffle 202, wherein, both of the plunger opening 201 and the plunger baffle 202 are inset in the second air discharge cylinder 102 and first air discharge cylinder 101 of the air discharge assembly 100 respectively.

Figure 15:
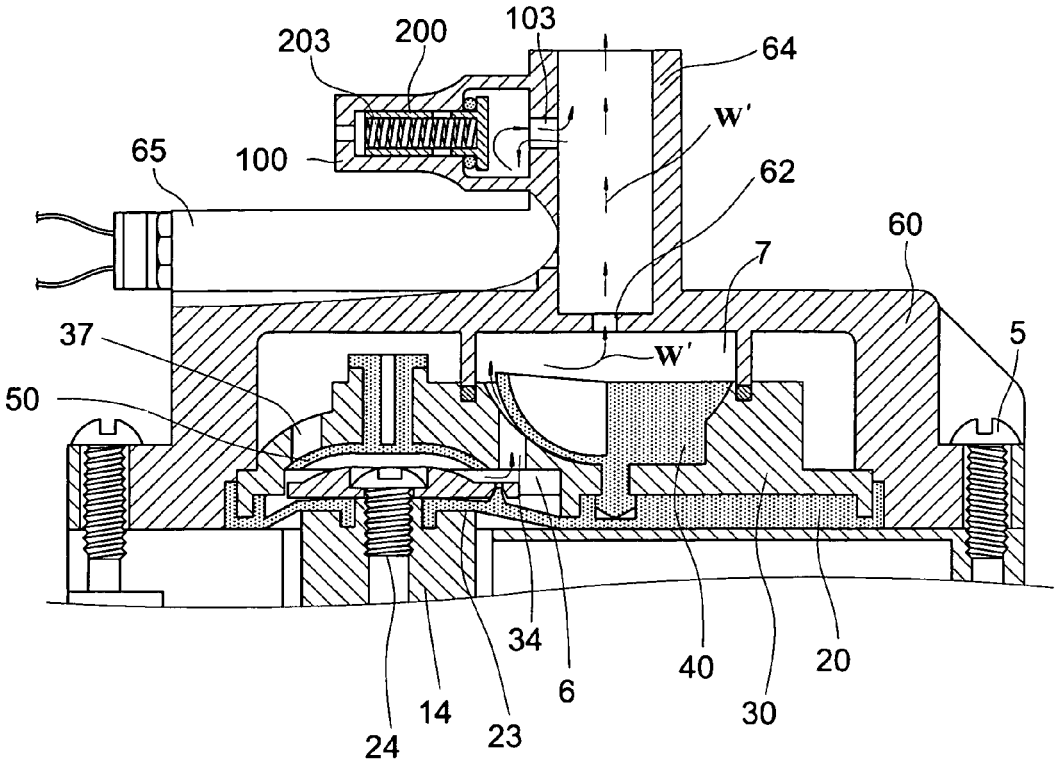
FIG. 15 is the first illustrative view showing the operation of the first exemplary embodiment in the present invention.
Figure 16:
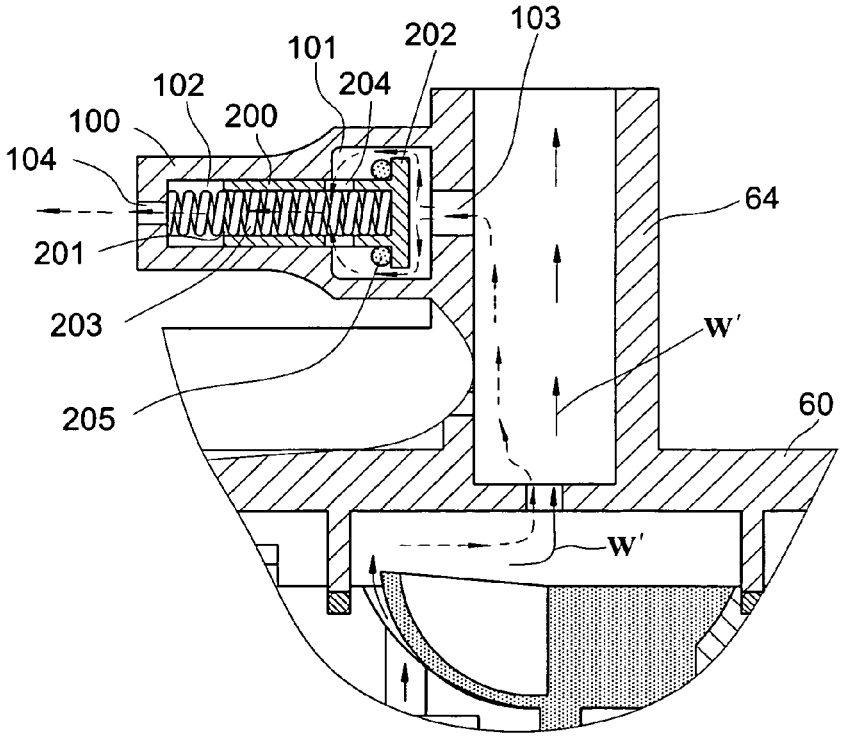
FIG. 16 is the second illustrative view showing the operation of the first exemplary embodiment in the present invention.

Please refer to the FIGS. 15 and 16, when no air being mixed within the pressurized water W' of the in the pressurized chamber 7 of the upper hood 60, the pressurized water W' passing through the water exit port 64 will simultaneously flow into the first air discharge cylinder 101 of the air discharge assembly 100 via air passage 103 and force the plunger baffle 202 of the plunger body 200 backwards such that entire plunger body 200 being pushed into the second air discharge cylinder 102 owing to the water pressure of the pressurized water W' being bigger than resilient force of the compressed spring 203. Meanwhile, the through pore 204 on the plunger body 200 is also entirely inserted into the second air discharge cylinder 102 so that the O-ring gasket 205 water-tightly closes the second air discharge cylinder 102 and forces all the pressurized water W' in the first air discharge cylinder 101 being directed out of the water exit port 64 (as the arrow head shown in the FIG. 15); this operation mode is the normal compressing and discharging water status. When air being mixed within the pressurized water W', the resilient force of the compressed spring 203 will push the plunger baffle 202 of the plunger body 200 forwards into the first air discharge cylinder 101 such that the through pore 204 passing into the first air discharge cylinder 101 owing to the resilient force of the compressed spring 203 being bigger than the water pressure of the pressurized water W'. Thereby, the air mixed in the pressurized water W' will get into the first air discharge cylinder 101 via air passage 103, then pass the plunger opening 201 of the plunger body 200 via through pore 204, and finally dispelled out of the upper hood 60 via the air discharge orifice 104 of the air discharge assembly 100 (as dashed arrow head shown in the FIG. 16); thus, the air-dispelling function is achieved. Until all the air having been dispelled out of the upper hood 60, the compressing diaphragm pump 10 for spray use will resume to normal compressing operation status, and the plunger body 200 in the air discharge assembly 100 will recover again back to the normal compressing and discharging water position (as shown in the FIG. 15).

Figure 17:
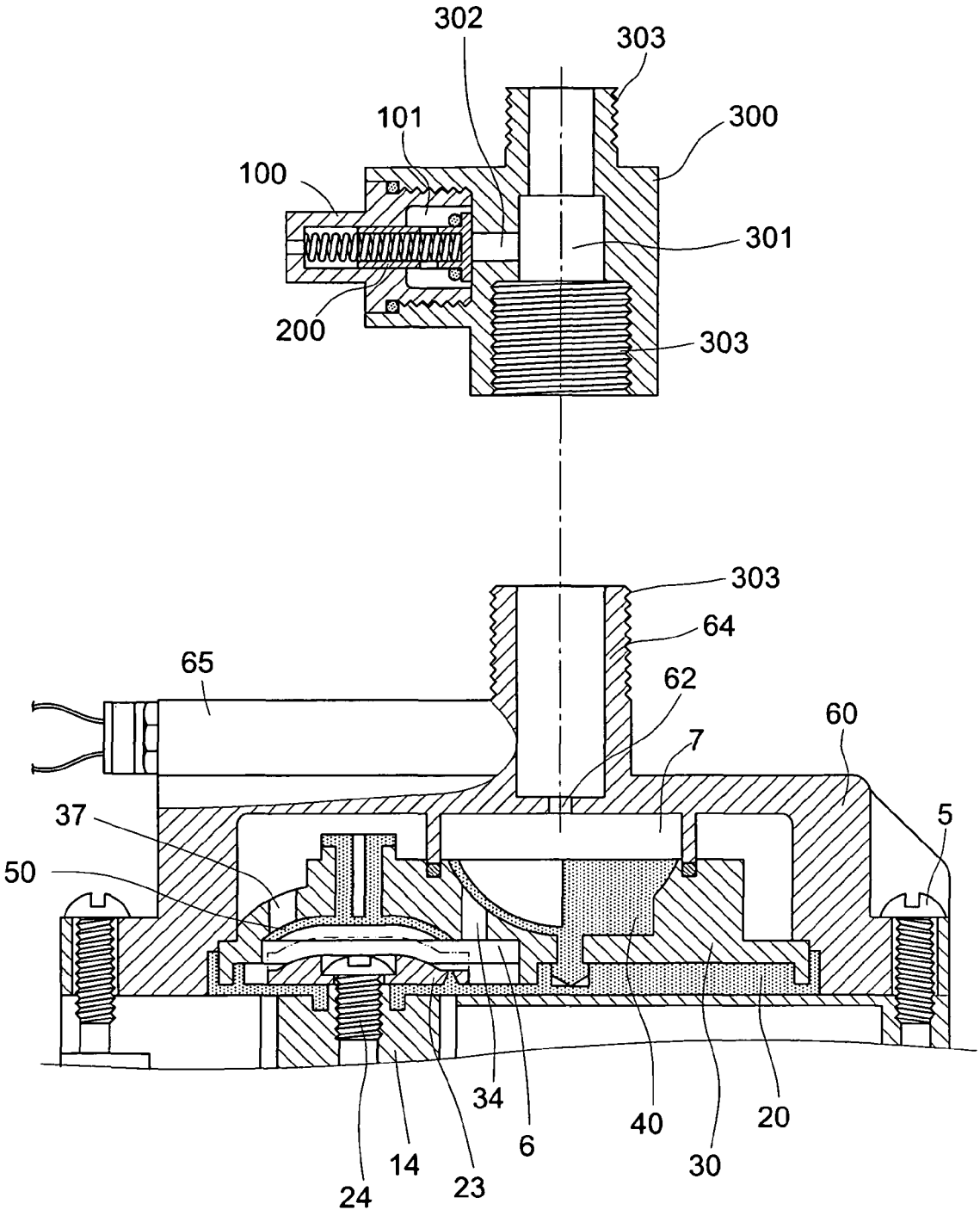
FIG. 17 is a sectional view showing the planar decomposition of the second exemplary embodiment of the present invention.
Figure 18:
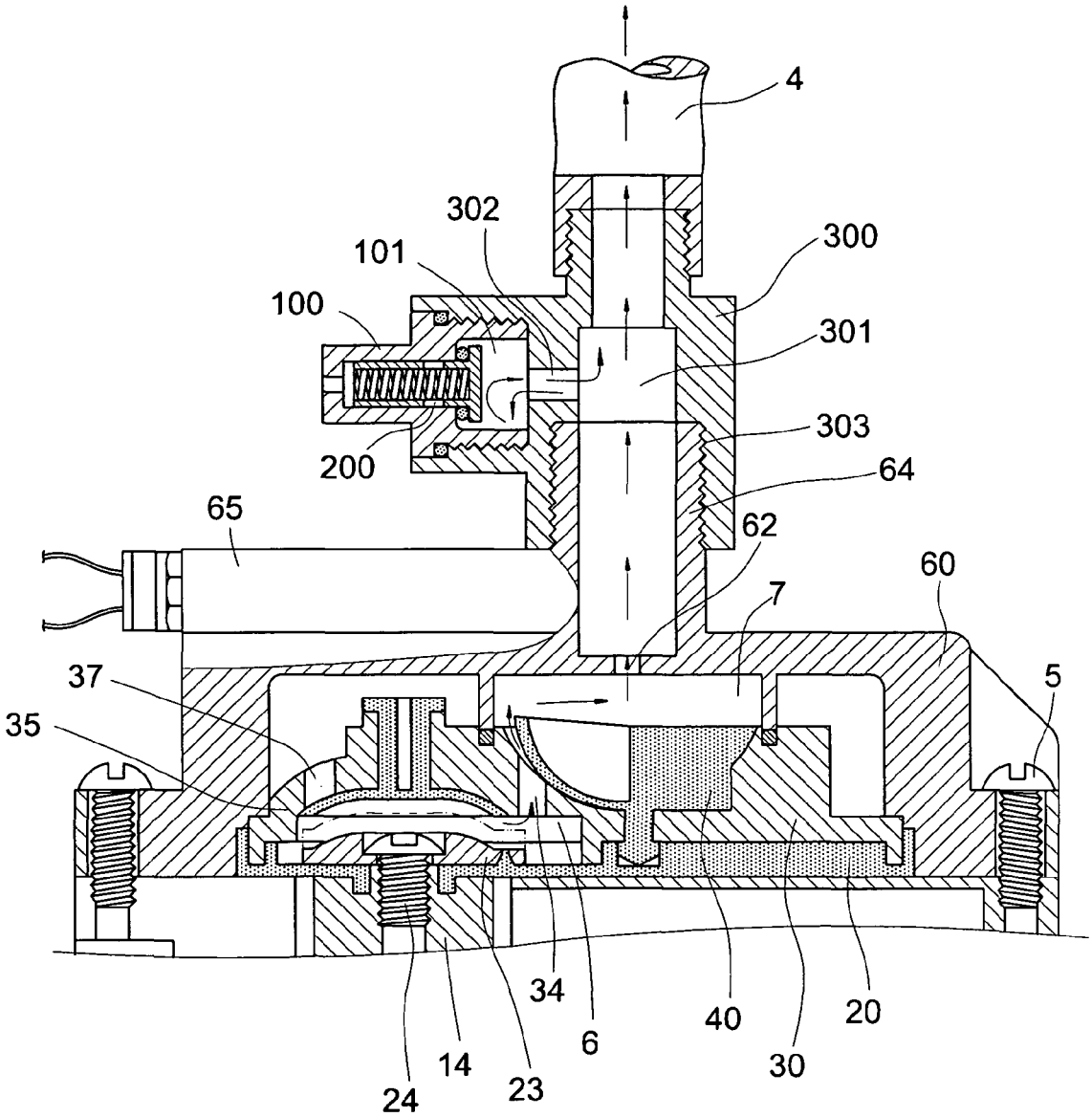
FIG. 18 is a sectional view showing the planar assembly of the second exemplary embodiment of the present invention.
Figure 19:
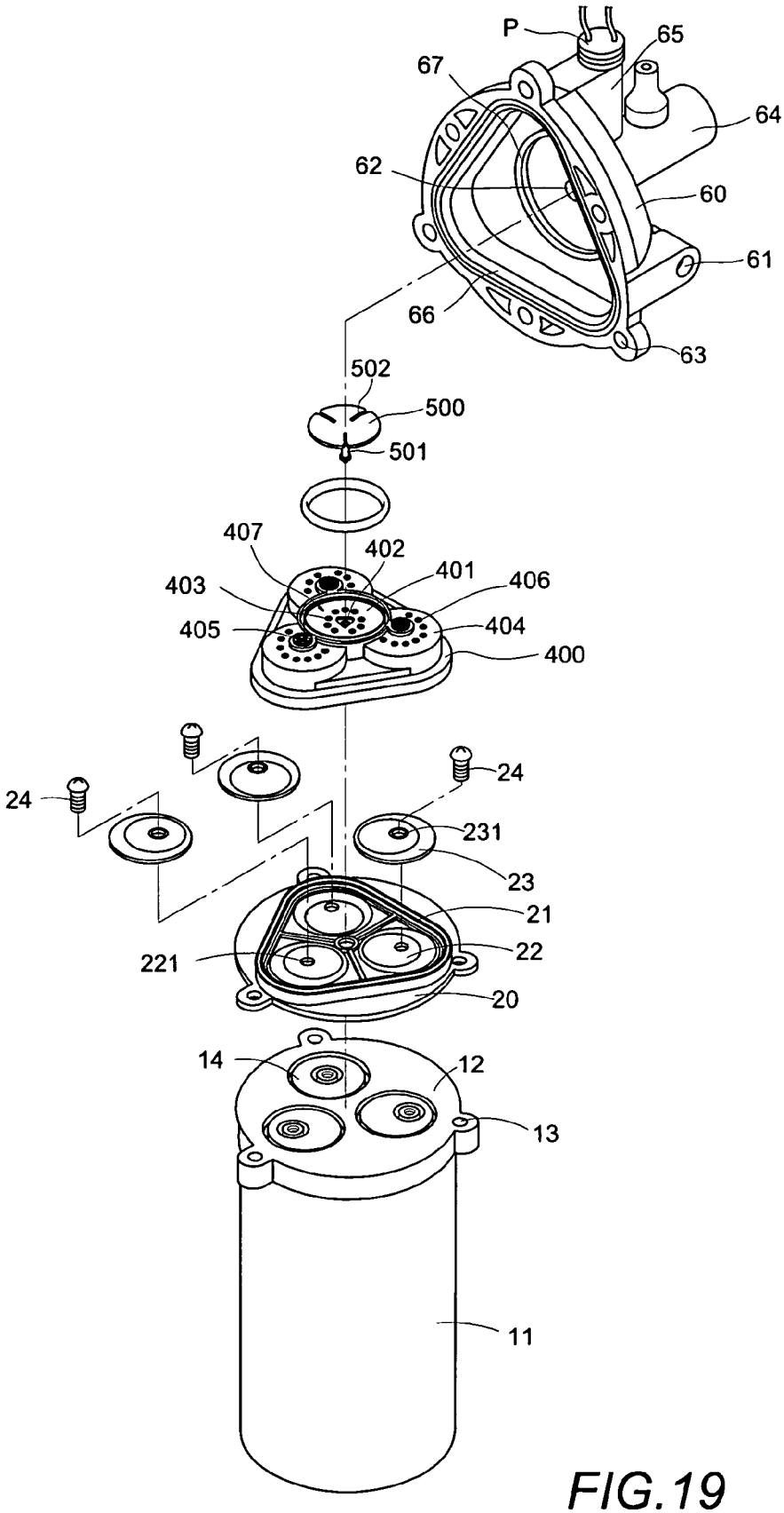
FIG. 19 is the first view showing the perspective exploded illustration of the third exemplary embodiment of the present invention.
Figure 20:
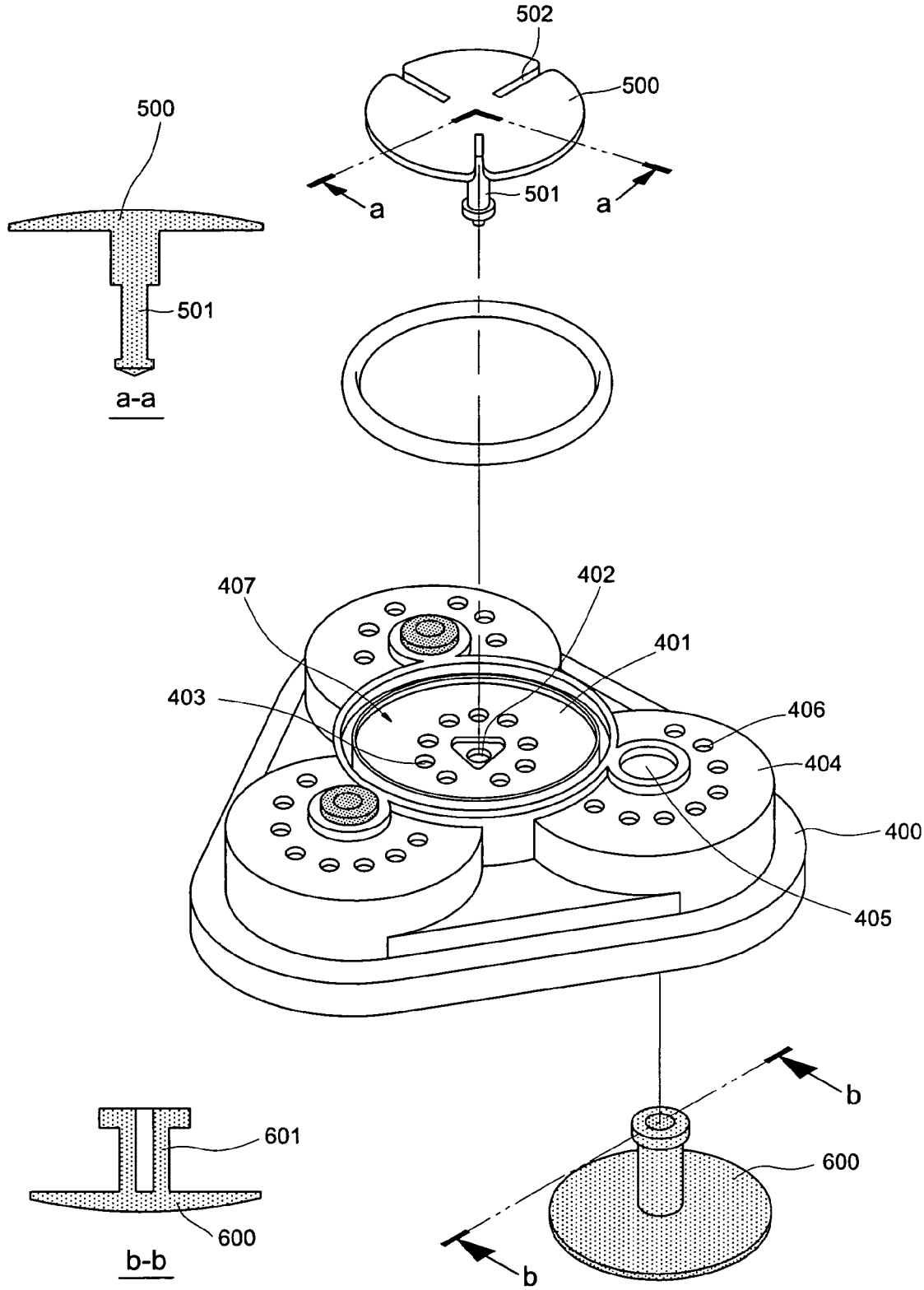
FIG. 20 is the second view showing the perspective exploded illustration of the piston valve for the third exemplary embodiment in the present invention.

As further shown in the FIGS. 17 and 18, the "compressing diaphragm pump having automatic air expelling and pressure regulating features for spray use" of the second exemplary embodiment in the present invention convertibly designs both of the air discharge assembly 100 and upper hood 60 are designed into detachable manner instead of permanently connecting status each other by having a fitting connector 300 configured at the bottom of the air discharge assembly 100 with an internal tiered bore 301 therein for connecting to the first air discharge cylinder 101 via the air passage 302 as well as threaded unions 303 respectively formed on each end thereof (as shown in the FIG. 17) for securely screwing with the water exit port 64 of the upper hood 60 and the water outtake conduit 4 respectively (as shown in the FIG. 18); Thus, the air discharge assembly 100 can achieve the same air expelling and pressure regulating effect as that in the first embodiment.

Figure 21:
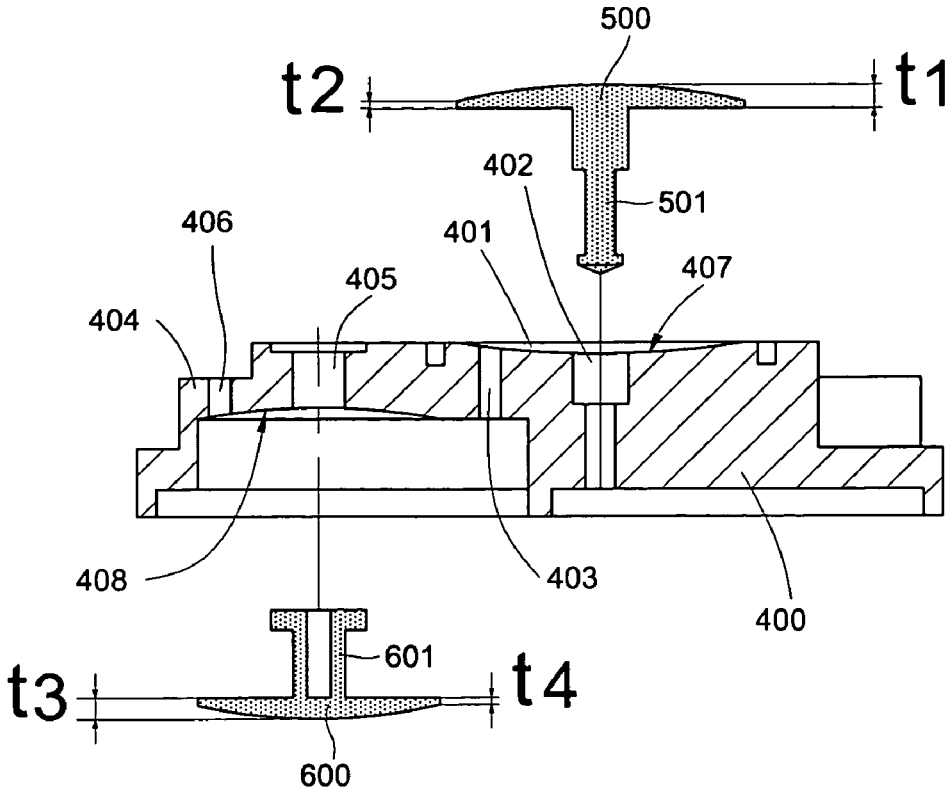
FIG. 21 is the section view showing the planar decomposition of the piston valve for the third exemplary embodiment of the present invention.

As further shown in the FIGS. 19 to 22, which shows the "compressing diaphragm pump having automatic air expelling and pressure regulating features for spray use" of the third exemplary embodiment in the present invention, wherein the top surface of the water discharge port 401 is designed into downwards camber concave 407 with center of the orientating hole 402 as lowest point (as shown in the FIG. 21) and each bottom surface of three water inlet ports 404 is designed into upwards camber concave 408 with center of the orientating hole 405 as lowest point (as shown in the FIG. 21). For coordinating with water discharge port 401 contrivance, the anti-backflow plastic gasket 500 is designed into upwards arched convex top surface and flat bottom surface with center thickness t1 is bigger than rim thickness t2 (as shown in view a-a of the FIG. 20 and the FIG. 21), and both of the anti-backflow plastic gasket 500 and the central orientating stem 501 projecting downwards are unitarily molded by same soft elastic material; For coordinating with water inlet port 404 contrivance, each of three piston slice 600 is also designed into downwards arched convex bottom surface and flat top surface with center thickness t3 is bigger than rim thickness t4 (as shown in view b-b of the FIG. 20 and the FIG. 21).

Figure 22:
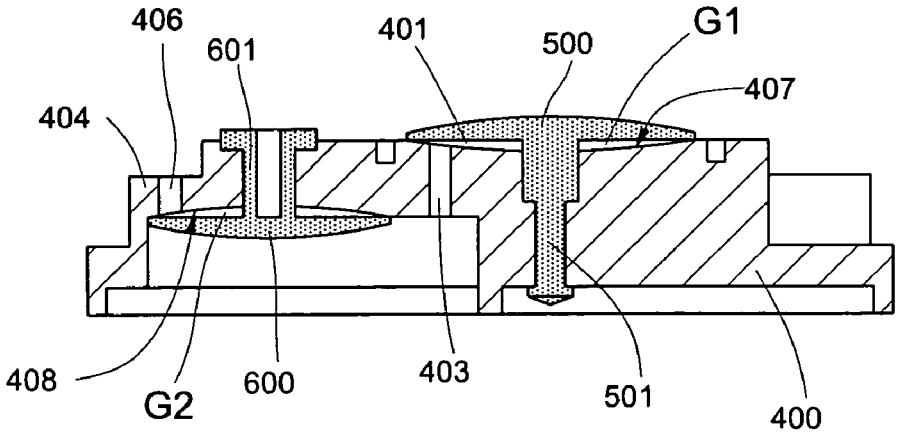
FIG. 22 is the section view showing the planar assembly of the piston valve for the third exemplary embodiment of the present invention.
Figure 23:
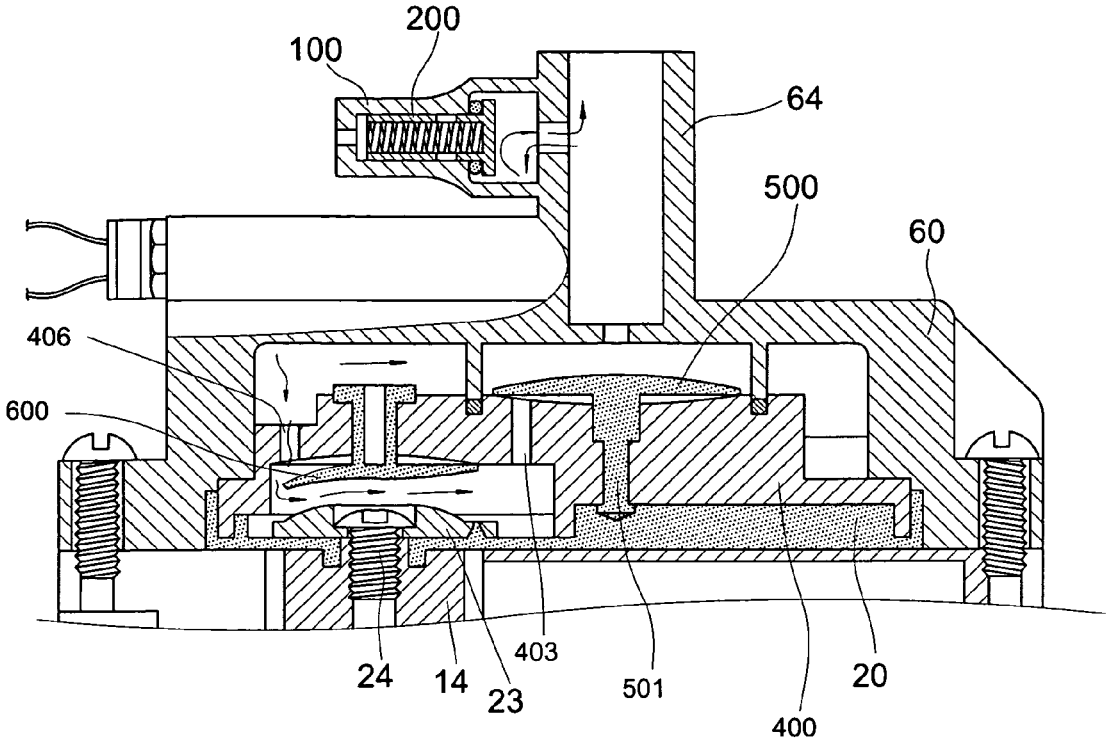
FIG. 23 is the first illustrative view showing the operation of the third exemplary embodiment in the present invention.
Figure 24:
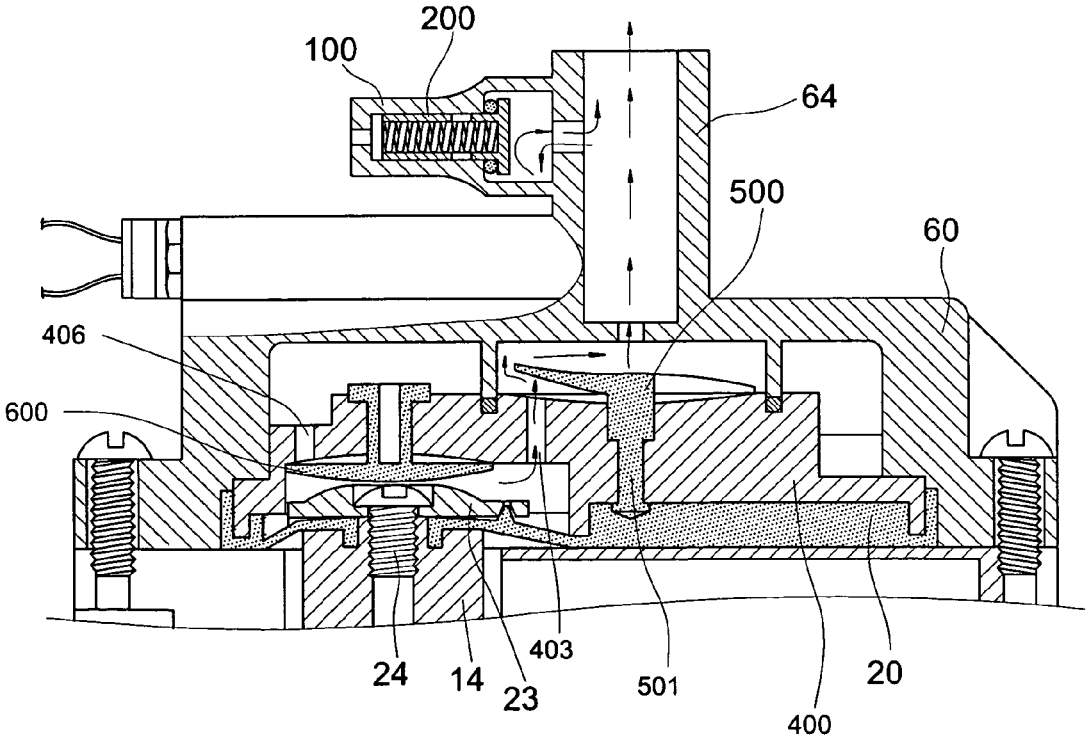
FIG. 24 is the second illustrative view showing the operation of the third exemplary embodiment in the present invention.

After assembly as shown in the FIGS. 22 through 24, a gap G1 is created between the flat bottom surface of the anti-backflow plastic gasket 500 and the downwards camber concave 407 of the water discharge port 401 (as shown in the FIG. 22); similarly, a gap G2 is created between the flat top surface of the piston slice 600 and the upwards camber concave 408 of the water inlet slots 406 (as shown in the FIG. 22). By means of the gaps of G1 and G2, not only the sucking force in each of the anti-backflow plastic gasket 500 and piston slice 600 in pumping action associated with the axial wobbling movement of the piston pushers 23 is considerably increased but also the pressurizing effect for the water is significantly promoted; Moreover, owing to the special design for uneven thickness in t1 and t2 on the anti-backflow plastic gasket 500 and t3 and t4 on the piston slice 600, not only its strength is better than that of the flat design in the precedent anti-backflow plastic gasket 80 in same thickness comparison, but also the sealing effect on the water discharge holes 403 and water inlet slots 406 during the switch between opening and closing actions is improved (as shown in the FIGS. 23 and 24); Thereby, the "abnormal pressure" issue has been totally eliminated; Furthermore, due to the unitarily molded component in the anti-backflow plastic gasket 500, not only the assembly procedure can be speeded up but also the manufacturing cost can be saved.

What is claimed is:

1. A compressing diaphragm pump having automatic air expelling feature for spray use comprises:

a motor;

an upper hood chassis disposed along the top of the output shaft of said motor, said upper hood chassis comprising plural screw bores formed on an outer rim;

multiple wobble wheels are pivoted on said upper hood chassis to serve as the pumping action in manner from axial reciprocal wobbling movement being driven by the output shaft of said motor;

a diaphragm covering said upper hood chassis;

a piston valve inset in said diaphragm;

an anti-backflow plastic gasket with three piston slices closely fixed on said piston valve respectively and an upper hood, wherein an air discharge assembly and a plunger body are disposed at the wall of the water exit port of the upper hood, wherein said air discharge assembly, which is a hollow tube, has a pair of first air discharge cylinder and second air discharge cylinder running freely through each other disposed on the upper section and lower section thereof respectively such that the diameter of the first air discharge cylinder being larger than that of the second air discharge cylinder, wherein an air passage is pierced at the wall between the first air discharge cylinder and the water exit port of the top upper hood as well as an air discharge orifice is pierced of the central top surface of the air discharge assembly facing towards the second air discharge cylinder, and said plunger body, which is a hollow tube with a top plunger opening and a bottom plunger baffle with outer diameter of the plunger opening is smaller than that of the plunger baffle, has a compressed spring disposed therein from the plunger opening facing inwards and a through pore pierced on the wall thereof near the plunger baffle as well as an O-ring gasket rimmed thereon the peripheral between the through pore and the plunger baffle, wherein, both of the plunger opening and the plunger baffle are inset in the second air discharge cylinder and first air discharge cylinder of the air discharge assembly respectively.

2. The compressing diaphragm pump having automatic air expelling feature for spray use as recited in the claim 1, wherein, both of the air discharge assembly and upper hood are designed into detachable manner instead of permanently connecting status each other by having a fitting connector configured at the bottom of the air discharge assembly with an internal tiered bore therein for connecting to the first air discharge cylinder via the air passage as well as a threaded union respectively formed on each end thereof.

* * * * *